US008763334B2

(12) United States Patent
O'Neill

(10) Patent No.: US 8,763,334 B2
(45) Date of Patent: Jul. 1, 2014

(54) THREE OR FIVE PIECE COMPONENT

(76) Inventor: Sean O'Neill, Toomebridge (GB)

( * ) Notice: Subject to any disclaimer, the term of this patent is extended or adjusted under 35 U.S.C. 154(b) by 0 days.

(21) Appl. No.: 13/503,563

(22) PCT Filed: Oct. 20, 2010

(86) PCT No.: PCT/GB2010/051769

§ 371 (c)(1),
(2), (4) Date: Jul. 9, 2012

(87) PCT Pub. No.: WO2011/048418

PCT Pub. Date: Apr. 28, 2011

(65) Prior Publication Data

US 2012/0276319 A1 Nov. 1, 2012

(30) Foreign Application Priority Data

Oct. 21, 2009 (GB) ..... 0918445.8

(51) Int. Cl.
*E06B 3/70* (2006.01)
*E06B 3/74* (2006.01)

(52) U.S. Cl.
CPC ..... *E06B 3/74* (2013.01); *E06B 3/7001* (2013.01)
USPC ..... 52/455; 52/784.1

(58) Field of Classification Search
CPC ..... E06B 3/74; E06B 3/7001; E06B 7/08; B27M 3/0093; B27M 3/18
USPC ..... 52/455, 458, 311.1, 311.2, 784.1; 428/44, 57, 58, 60
See application file for complete search history.

(56) References Cited

U.S. PATENT DOCUMENTS

| | | | | | |
|---|---|---|---|---|---|
| 4,471,012 | A | * | 9/1984 | Maxwell | 428/106 |
| 4,702,054 | A | * | 10/1987 | Turner | 52/455 |
| 4,704,834 | A | * | 11/1987 | Turner | 52/311.2 |
| 4,756,350 | A | * | 7/1988 | Turner | 144/346 |
| 4,853,062 | A | * | 8/1989 | Gartland | 156/219 |
| 4,870,797 | A | * | 10/1989 | Hagemeyer | 52/455 |
| 5,317,853 | A | * | 6/1994 | Lopes | 52/456 |
| 5,526,857 | A | * | 6/1996 | Forman | 144/346 |
| 5,540,026 | A | * | 7/1996 | Gartland | 52/455 |
| 5,584,154 | A | * | 12/1996 | Koepke et al. | 52/456 |
| 5,704,182 | A | * | 1/1998 | Schiedegger | 52/457 |
| 5,761,865 | A | * | 6/1998 | Schiedegger et al. | 52/473 |
| 5,946,873 | A | * | 9/1999 | Schiedegger et al. | 52/457 |

(Continued)

FOREIGN PATENT DOCUMENTS

DE 20316666 1/2004

OTHER PUBLICATIONS

English Abstract of DE 20316666.

*Primary Examiner* — William Gilbert
*Assistant Examiner* — James Ference
(74) *Attorney, Agent, or Firm* — Preston Smirman; Smirman IP Law, PLLC

(57) ABSTRACT

A three piece component (1, 51) comprising a main body (5, 50) having two stiles (3, 65) and at least one panel member (4, 56) intermediate and integrally formed with the two stiles (3, 65). At least one end of the main body (5, 50) defines an opening (6, 59) in the main body (5, 50) where the stiles (3, 65) extend beyond the panel member (4, 56) and at least one rail (2, 81) is formed for insertion into the opening (6, 59) at the end of the main body (5, 50).

10 Claims, 13 Drawing Sheets

(56) References Cited

U.S. PATENT DOCUMENTS

| | | | | |
|---|---|---|---|---|
| 6,023,905 | A * | 2/2000 | Schiedegger | 52/745.19 |
| 6,122,875 | A * | 9/2000 | Schiedegger et al. | 52/457 |
| 6,141,938 | A * | 11/2000 | Schiedegger | 52/745.19 |
| 6,185,894 | B1 * | 2/2001 | Sisco et al. | 52/457 |
| 6,487,824 | B1 * | 12/2002 | West et al. | 52/309.11 |
| 6,487,827 | B2 * | 12/2002 | Hollman | 52/455 |
| 6,497,938 | B1 * | 12/2002 | Hill | 428/131 |
| 6,584,667 | B1 * | 7/2003 | Frumkin | 29/458 |
| 6,684,590 | B2 * | 2/2004 | Frumkin | 52/456 |
| 7,143,561 | B2 * | 12/2006 | Hollman | 52/456 |
| 2002/0011041 | A1 * | 1/2002 | Frumkin | 52/456 |
| 2002/0083649 | A1 * | 7/2002 | Hollman | 49/504 |
| 2003/0205015 | A1 * | 11/2003 | Birmingham et al. | 52/455 |
| 2004/0111993 | A1 * | 6/2004 | Hollman | 52/384 |
| 2004/0187398 | A1 * | 9/2004 | Schiedegger et al. | 52/73 |
| 2005/0072085 | A1 * | 4/2005 | Goudreau | 52/455 |
| 2005/0076593 | A1 * | 4/2005 | Bartlett et al. | 52/455 |
| 2005/0210797 | A1 * | 9/2005 | Hees | 52/455 |
| 2005/0284030 | A1 * | 12/2005 | Autovino et al. | 52/1 |
| 2005/0284099 | A1 * | 12/2005 | Yu | 52/784.1 |
| 2006/0053744 | A1 * | 3/2006 | Thompson et al. | 52/784.1 |
| 2006/0283121 | A1 * | 12/2006 | Graboyes | 52/455 |
| 2007/0039270 | A1 * | 2/2007 | Hollman | 52/456 |
| 2007/0107349 | A1 * | 5/2007 | Erker | 52/455 |
| 2007/0193220 | A1 * | 8/2007 | Daniels | 52/784.11 |
| 2007/0251174 | A1 * | 11/2007 | Chung | 52/455 |
| 2010/0154340 | A1 * | 6/2010 | Schiedegger et al. | 52/473 |
| 2010/0175328 | A1 * | 7/2010 | Hess | 49/404 |
| 2013/0052388 | A1 * | 2/2013 | Burrows et al. | 428/54 |

* cited by examiner

SECTION A-A

DETAIL B

THREE OR FIVE PIECE COMPONENT

CROSS-REFERENCE TO RELATED APPLICATION

The instant application is a national phase of, and claims priority to, PCT International Application No. PCT/GB2010/051769, filed on Oct. 20, 2010, pending, and GB Patent Application Serial No. 0918445.8, filed on Oct. 21, 2009, pending, the entire specifications of both of which are expressly incorporated herein by reference.

The present invention relates to a three or five piece component and in particular to a three or five piece door for the fitted kitchen industry.

Doors for fitted kitchens come in a variety of styles from the most expensive solid wood doors which are hand made to the least expensive medium density fibreboard MDF or similar type vinyl wrap doors. The doors have a number of key differentiating features namely the look and feel of the wood grain effect, in particular its direction and the look and feel of the joints or locations where the joints should be. The wood grain effect of real wood doors extends in the same direction on the two stiles and the central panel and the wood grain effect of the rails is perpendicular to this direction because the door is made from separate pieces. The one piece imitation doors are mass produced using cutting and routing techniques to give the doors a superficial similarity to real wood doors. The door panels are produced using a single piece of base board wrapped in a vinyl covering material. The mass produced doors do not have the high quality wood grain effect as the wood grain on the stiles, panel and rails of the one piece doors extends in the same direction in a uniform pattern. The uniform pattern of the wood grain effect as well as the lack of actual joints present in these mass produced one piece doors creates a kitchen door which is a poor cousin of the solid wood door.

Attempts to recreate the look and feel of a hand made solid wood kitchen door using industrial techniques facilitating mass production have been made. A five piece door wrapped in vinyl has been developed which comprises a separate central panel, two separate stiles and two separate rails. The five piece door has the benefit of accurately imitating the wood grain effect of the solid wood doors. However, the five piece door has a number of inherent problems as a result of the manufacturing process. Initially, the stiles are cut from lengths of material so the cut ends of the stiles must be taped to improve their visual appearance. As a result, it is not possible to have a molded edge along the perimeter of the five piece door. Furthermore, as with any separable component, the tape is prone to pulling away from the cut edge of the stiles with wear and tear which ultimately ruins the look of the door and can lead to moisture absorption. The stiles of the five piece door also have a groove for receiving the central panel. The stiles are wrapped on a linear wrapping machine so it is not possible for the wrapping machine to completely cover the bottom of the groove with vinyl. As a result the exposed MDF or similar chipboard material is prone to absorbing moisture and ultimately swelling which again over time diminishes or ruins the visual appearance of the kitchen door.

An alternative attempt to imitate the look and feel of the solid wood doors from cheaper materials has been made by using a one piece panel with the areas corresponding to the rails being machined down to leave a gap for slips which are glued on. This allows the cheaper door to imitate the wood grain effect of the solid wood doors but this style of door has its own inherent problems. In order to cover the gap between the glue-on-slips and the cutaway portion of the door panel, a tape must be glued along the edge to seal the gap of this style of door. The problem with this construction is that the tape eventually pulls away from the edge impairing the look of the door and leading to exposed MDF causing problems with moisture absorption and swelling. As a result of the tape being glued onto the edge, it is not possible for these doors to have a moulded edge along their perimeter.

It is an object of the present invention to obviate or mitigate the problems associated with the five piece doors and the glue-on-slip type doors discussed above.

Accordingly, the present invention provides a three piece component comprising a main body having two stiles and at least one panel member intermediate and integrally formed with the two stiles, at least one end of the main body defining an opening in the main body where the stiles extend beyond the panel member and at least one separate rail being formed for insertion into the opening at one end of the main body.

Ideally, coupling means are operable between the rail and the main body for coupling the rails into planar alignment with the main body and for preventing relative lateral movement between the rail and main body.

Ideally, opposing ends of the main body each define an opening for receiving a rail formed for insertion in to each opening.

Preferably, the rails are formed for insertion between extended portions of the stiles.

Preferably, the main body is substantially H-shaped.

Advantageously, the H-shaped main body of the three piece component can be completely wrapped in a covering material by a wrapping machine in a single process and the two separate rails can be completely wrapped in a covering material separately. This means that the possibility of the MDF/fibre board or similar base material absorbing moisture is significantly reduced increasing the lifetime of the three piece components. The three piece component can readily imitate the wood grain effect of the more expensive solid wood door. The design of the three piece component with the H shaped main body also reduces the number of components required to create imitation solid wood doors. The reduction in the number of parts reduces the manufacturing costs and reduces the complexity of the assembly of the three piece component. There is also the added benefit of a moulding edge being applied all the way around the perimeter of the three piece component as no straight edges are left requiring a tape to be glued onto the edge.

Preferably, the three piece component is a building unit such as a door, building panel or a coffin side. In one particularly preferred embodiment, the three piece component is a kitchen unit door.

Ideally, the main body is integrally formed from a sheet of MDF or other low grade wood or chip board or any other low cost panelling material of sufficient rigidity and strength to act as the required building unit.

Preferably, the two separate rails are formed from a sheet of mdf or other low grade wood or chip board or any other low cost panelling material of sufficient rigidity and strength to act as the required building unit.

Preferably, the openings defined by the extending stiles are quadrangular and most preferably substantially rectangular. It will of course be appreciated that any shape of opening suitable for creating various styles of three piece component are encompassed by the present invention and quadrangular and substantially rectangular are provided as exemplary only.

Ideally, the coupling means comprises expandable glue or foam.

Preferably, the expandable glue or foam is located within recesses on the inner surfaces of the openings expandable into correspondingly located recesses on the outer surfaces of the rails.

Alternatively, the expandable glue or foam is located within recesses on the outer surfaces of the rails expandable into correspondingly located recesses on the inner surfaces of the openings.

Ideally, the coupling means are provided by mating members on locations of the inner surfaces of the openings and cooperating mating members on corresponding locations of the outer surfaces of the rails.

Preferably, the coupling means is provided by a pair of elongate protruding male members on mutually opposing inner surfaces of both openings and by a pair of elongate female slots on corresponding locations of opposing outer surfaces of the rails.

Ideally, the elongate female slots each have one open end to allow the rails to be slid onto the elongate protruding male members to bring the rails into planar alignment with the remainder of the H-shaped main body as the rails are slid into place.

Preferably, the H-shaped main body is completely wrapped in a covering material/veneer. The term completely wrapped means that no base panelling material is left exposed to absorb moisture.

Ideally, the two separate rails are completely wrapped in a covering material/veneer.

Preferably, the covering material/veneer comprises a moisture resistant coating.

Ideally, the moisture resistant coating is a sheet material capable of preventing the ingress of moisture into the material of the H-shaped main body or separate rails.

Ideally, the covering material/veneer is provided by PVC, vinyl, paint, melamine or a backing foil.

In another embodiment, the covering material/veneer is applied using a print transfer process.

Preferably, both ends of the leading edge of each rail are beveled and both ends of the bottom surface of each opening are beveled creating four mitre joints at the four corners of the panel.

Ideally, the panel of the H-shaped main body has an annular recessed portion defining a central platform.

Preferably, the inclined surfaces between the annular recessed portion and the central platform and stiles have an ornamental design.

Ideally, the leading edge of each rail has the same inclined ornamental surface.

Preferably, the peripheral edge of the H-shaped main body is moulded.

Ideally, the peripheral edge of the rails is moulded. Advantageously, the moulded peripheral edges of the rails align with the moulded peripheral edge of the H-shaped main body to provide a three piece component with a moulded perimeter.

Preferably, the three piece component has a front visible surface which is on display in normal use and a rear hidden surface which is not visible unless the component is in an open position. Advantageously, this open position is only adopted for a minority of time compared to the normal closed position.

In a particularly preferred embodiment of three piece component, a short beveled portion of material extends between a location proximal to each corner of the central panel and a location along the internal surface of the length of each of the protruding stile portions defining the opening, each short beveled portion of material having an edge and each inner surface of the protruding stile portion having an edge proximal to the front visible surface of the three piece component, wherein the visible intersection between the edge of each short beveled portion with the edge of the opening defining inner surface of each stile defines a sharp rectilinear intersection angle with no internal radius. Advantageously, this sharply defined intersection angle exactly imitates the visual appearance of the same part of a solid wood five piece door.

Ideally, the edge proximal to the front visible surface of the three piece component defines the boundary between the beveled inclined surfaces extending between the annular recessed portion and the stiles and the beveled surfaces of the opening which beveled surfaces are substantially perpendicular to the main plane of the three piece component Preferably, the sharp rectilinear intersection angle with no internal radius is an angle in the range of 120° to 150°.

Ideally, an undercut is formed in the opening defining inner surface of each stile proximal to the intersection of the edge of the short beveled portion of material with the edge of the opening defining inner surface of each stile.

Preferably, the undercut is formed a short distance below the main surface of the stile. Advantageously, the integrity of the rectilinear edge of the protruding portion of the stile forming the opening is unaffected by the undercut. The undercut allows the specially designed cutting tool to be buried into the body of the stile so as to run out a true rectilinear edge creating the sharp rectilinear intersection angle.

Ideally, both separable rails have two short beveled portions formed for mating engagement with the beveled portions of the openings to create beveled preferably mitre joints.

In this particularly preferred embodiment, the separable rail also has two short beveled portions proximal to a leading edge of the rail between the outer lateral surfaces formed for engagement with the opening defining surfaces of the stiles and a leading surface of the rail formed for engagement with an opening defining external surface of the central panel.

Ideally, the beveled portions of the rail are formed for mating engagement with the beveled portions of the opening to create the beveled joint. Advantageously, this joint identically imitates the solid wood five piece door.

Preferably, the joint is a mitre joint.

Ideally, at least one or any combination of the outer lateral surfaces, the beveled surfaces and the leading surface of the rail have coupling means formed for operable engagement with correspondingly located coupling means on the internal surfaces of stiles, the beveled surfaces of the beveled portion and/or the external surface of the central panel forming the opening.

Ideally, the beveled surfaces of the short beveled portions defining the opening taper at a slight angle from the front visible surface towards the rear hidden surface.

Preferably, the taper angle is in the range of 1° to 5°.

Ideally, the beveled surfaces of the short beveled portions of the separable rail taper at a slight angle from the front visible surface towards the rear hidden surface.

Preferably, the taper angle is in the range of 1° to 5°.

Advantageously, the slight taper angle of the beveled surfaces means that the corresponding edges of the beveled surfaces of the rail and the main body proximal to the front visible surface of the three piece component come into contact with each other before any other part of the beveled surfaces when the rails are slid into position for forming the complete component. This ensures that there is never any visible gap between these corresponding edges thereby endeavouring to imitate the solid wood door as closely as possible.

Accordingly, the present invention provides a method of forming a three piece component comprising the steps of machining a main body having two stiles and at least one panel member intermediate and integrally formed with the two stiles, at least one end of the main body defining an opening in the main body where the stiles protrude beyond the main body, the method further comprising machining two short beveled portions of material between a location proximal to each corner of the central panel and a location along the internal surface of the length of each of the protruding stile portions defining the opening so that each short beveled portion of material has an edge proximal to the front visible surface of the three piece component, machining an edge on the inner surface of the stiles so that the visible intersection between the edge of each short beveled portion with the edge of the opening defining inner surface of each stile defines a sharp rectilinear intersection angle with no internal radius. Advantageously, this sharply defined intersection angle exactly imitates the visual appearance of the same part of a solid wood five piece door.

Ideally, the method comprising machining an opening on opposing ends of the main body.

Preferably, the method comprising forming the sharp rectilinear intersection angle with no internal radius at an angle in the range of 120° to 150°.

Ideally, the method comprising machining an undercut in the opening defining inner surface of each stile prior to or after machining the short beveled portion of material so that no internal radius is visible at the intersection between the edge of each short beveled portion with the edge of the opening defining inner surface of each stile.

Preferably, the method comprising machining the undercut a short distance below the main surface of the stile. Advantageously, the integrity of the rectilinear edge of the protruding portion of the stile forming the opening is unaffected by the undercut.

Ideally, the method comprising machining the edge of the separable rail so as to have two short beveled portions proximal to a leading edge of the rail between the outer lateral surfaces formed for engagement with the opening defining surfaces of the stiles and a leading surface of the rail formed for engagement with an opening defining external surface of the central panel.

Preferably, the method comprising machining the beveled portions of the rail and the beveled portions of the opening to create a beveled joint, preferably a mitre joint. Advantageously, this joint identically imitates the solid wood five piece door.

Ideally, the method comprising machining at least one or any combination of the outer lateral surfaces, beveled surfaces of the beveled portions and the leading surface of the rail so as to have coupling means formed for operable engagement with correspondingly located coupling means machined on the internal surfaces of the stiles, the beveled surfaces of the beveled portion and/or the external surface of the central panel forming the opening.

Preferably, the method comprising machining the beveled surfaces of the short beveled portions defining the opening so that the beveled surfaces taper at a slight angle from the front visible surface towards the rear hidden surface of the three piece component.

Preferably, the method comprising machining a taper angle in the range of 1° to 5°.

Ideally, the method comprising machining the beveled surfaces of the separable rail so that the beveled surfaces taper at a slight angle from the front visible surface towards the rear hidden surface of the three piece component.

Preferably, the method comprising machining the taper angle in the range of 1° to 5° and most preferably 3°.

Ideally, the machining is carried out by a router.

Accordingly, the present invention also provides a five piece component comprising two stiles and at least one panel member mountable intermediate the two stiles to form a main body, at least one end of the main body defining an opening in the main body where the stiles extend beyond the panel member and at least one separable rail being formed for insertion into the opening at the end of the main body, wherein short beveled portions extend from an inner opening defining surface of the stiles to a location proximal to a corresponding corner of the panel, each short beveled portion of material having an edge and each protruding stile portion having an edge proximal to a front visible surface of the three piece component, wherein a visible intersection between the edge of each short beveled portion with an edge of the opening defining inner surface of each stile defines a sharp rectilinear intersection angle with no internal radius.

Ideally, the short beveled portions are formed as part of the stiles.

Alternatively, the short beveled portions are formed as part of the central panel.

Ideally, coupling means are provided operable between the rail and the main body for coupling the rails into planar alignment with the main body and for preventing relative lateral movement between the rails and main body, Ideally, opposing ends of the main body each define an opening for receiving a rail formed for insertion in to each opening.

Ideally, rails are formed for insertion between extended portions of the stiles.

Preferably, the main body is substantially H-shaped.

Ideally, the sharp rectilinear intersection angle with no internal radius is an angle in the range of 120° to 150°.

Ideally, an undercut is formed in the opening defining inner surface of each stile proximal to the intersection of the edge of the short beveled portion of material with the edge of the opening defining inner surface of each stile.

Preferably, the undercut is formed a short distance below the main surface of the stile.

Ideally, both separable rails have two short beveled portions formed for mating engagement with the beveled portions of the openings to create beveled joints.

Preferably, the beveled surfaces of the short beveled portions of the separable rails taper at a slight angle from the front visible surface towards the rear hidden surface.

Ideally, the beveled surfaces of the short beveled portions defining the openings in the main body taper at a slight angle from the front visible surface towards the rear hidden surface.

Preferably, the taper angle is in the range of 1° to 5°.

A method of forming a five piece component comprising the steps of machining two separate stiles and at least one panel member mountable intermediate the two stiles to form a main body, at least one end of the main body defining an opening where the stiles protrude beyond the main body, the method further comprising machining two short beveled portions of material between a location proximal to each corner of the central panel and a location along the internal surface of the length of each of the protruding stile portions defining the opening so that each short beveled portion of material has an edge proximal to a front visible surface of the three piece component, machining an edge on the inner surface of the stiles so that the visible intersection between the edge of each short beveled portion with the edge of the opening defining inner surface of each stile defines a sharp rectilinear intersection angle with no internal radius.

A method of forming a five piece component comprising the step of forming the sharp rectilinear intersection angle with no internal radius at an angle in the range of 120° to 150°.

A method of forming a five piece component, comprising the step of machining an undercut in the opening defining inner surface of each stile prior to or after machining the short beveled portion of material so that no internal radius is visible at the intersection between the edge of each short beveled portion with the edge of the opening defining inner surface of each stile.

A method of forming a five piece component, comprising the step of machining the undercut a short distance below the main surface of the stile.

A method of forming a five piece component, comprising the step of machining two beveled surfaces of the separable rail so that the beveled surfaces taper at a slight angle from the front visible surface towards the rear hidden surface of the three piece component.

A method of forming a five piece component, comprising the step of machining the beveled surfaces of the short beveled portions defining the opening so that the beveled surfaces taper at a slight angle from the front visible surface towards the rear hidden surface of the three piece component.

A method of forming a five piece component, comprising the step of machining a taper angle in the range of 1° to 5°.

A method of machining a beveled intersection angle between peripheral surfaces of a panel, the peripheral surfaces being substantially perpendicular to the main plane of the panel so that the visible intersection angle between the edge of a short beveled portion with the edge of the portion of the panel proximal to the beveled portion defines a sharp rectilinear intersection angle with no internal radius, the method comprising the step of machining an undercut a short distance below the main surface of the panel in at least one peripheral surface before or after machining the short beveled portion of material so that no internal radius is visible at the intersection between the edge of the short beveled portion with the edge of the portion of the panel proximal to the beveled portion.

The invention will now be described with reference to the accompanying drawings which show by way of example only one embodiment of a three piece modular door in accordance with the invention. In the drawings.

Figure 1:
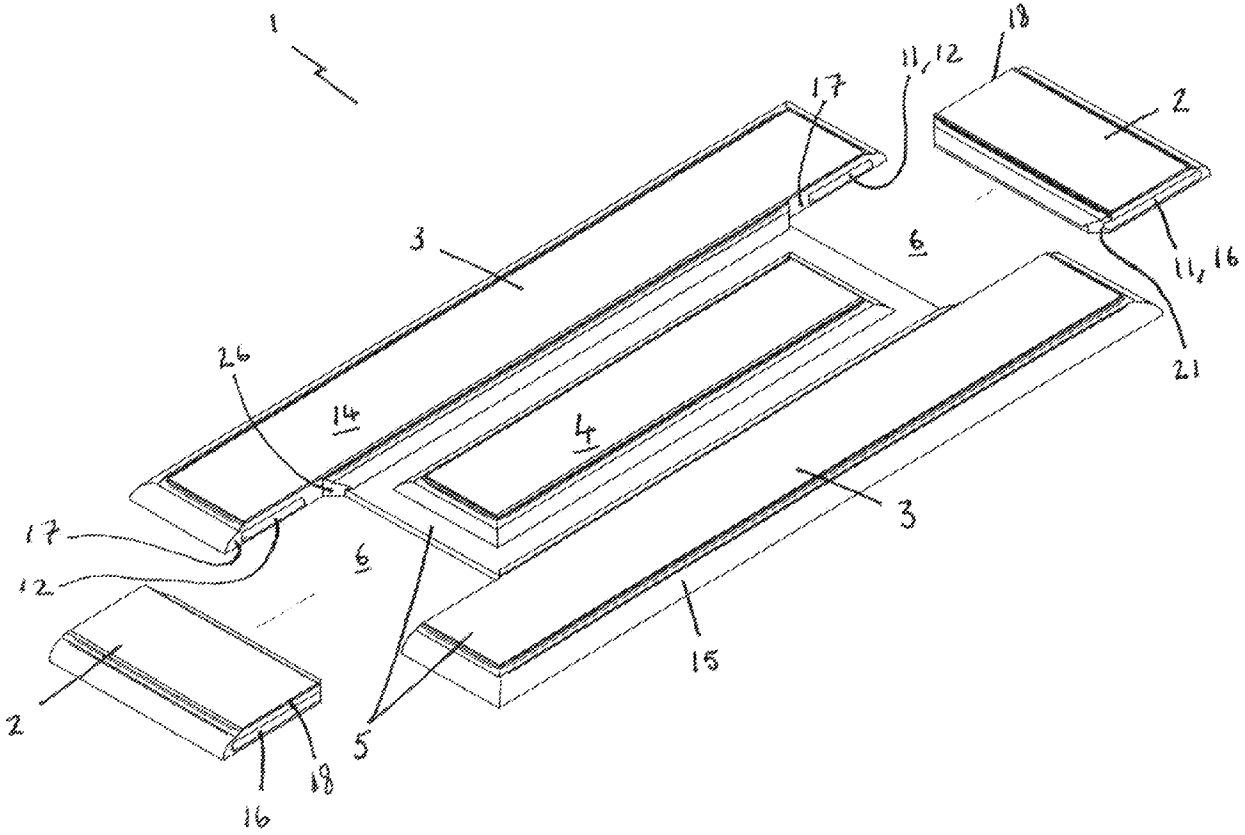
FIG. 1 is an exploded perspective view of the three piece component.

In the drawing, there is shown a three piece component which will be subsequently described as a door indicated generally by the reference numeral 1. It will of course be appreciated that a door is one example of a three piece component suitable for use as a building unit and in no way limits the invention. The three piece component being of the type having a frame of rails 2 and stiles 3 and one panel 4 located there between. The door 1 has a main body 5 having two stiles 3 and one panel member 4 intermediate and integrally formed with the two stiles 3. The main body 5 has a substantially H-shape in plan view where the ends of the stiles 3 extend beyond the panel member 4 at opposing ends of the main body 5 defining two openings 6 in the main body 5. Two separate rails 2 are formed for insertion between the extended portions of the stiles 3 into the openings 6 at opposing ends of the main body 5 to form a complete door 1, see FIG. 2. A coupling arrangement 11 is provided for coupling the rails 2 into planar alignment with the main body 5 and for preventing relative lateral movement between the rails 2 and main body 5.

Advantageously, the H-shaped main body 5 of the three piece door 1 is completely wrapped in a covering material 14 by a wrapping machine in a single process and the two separate rails 2 is completely wrapped in a covering material 14 separately. This means that the possibility of the MDF/fibre board or similar base panelling material absorbing moisture is significantly reduced increasing the lifetime of the doors 1 or other building units. The three piece door 1 can readily imitate the wood grain effect of the more expensive solid wood door. The design of the three piece door 1 with the H shaped main body 5 also reduces the number of components required to create panel doors to imitate solid wood doors. The reduction in the number of parts reduces the manufacturing costs and reduces the complexity of the assembly of the doors 1. There is also the added benefit of a moulded edge 15 extending all the way around the perimeter of the door 1 as there are no straight edges to be taped unlike the five piece doors and the doors with the glue-on-slips.

The H-shaped main body 5 is integrally formed from a sheet of MDF or other low grade wood or chip board or any other low cost panelling material of sufficient rigidity and strength to act as a door. The two separate rails 2 are also formed from a sheet of mdf or other low grade wood or chip board or any other low cost panelling material of sufficient rigidity and strength to act as a door 1. The openings 6 defined by the extending stiles 3 are quadrangular and most preferably substantially rectangular. It will of course be appreciated that any shape of opening suitable for creating various styles of door 1 are encompassed by the present invention and quadrangular and substantially rectangular are provided as exemplary only.

The coupling arrangement 11 is provided by a pair of elongate protruding male members 12 on mutually opposing inner surfaces 17 of both openings 6 and by a pair of elongate female slots 16 on corresponding locations of opposing outer surfaces 18 of the rails 2. The elongate female slots 16 each have one open end 21 to allow the rails 2 to be slid onto the elongate protruding male members 12 to bring the rails 2 into planar alignment with the remainder of the H-shaped main body 5 of the door 1 as the rails 2 are slid into place. Both ends 23 of the leading edge 24 of each rail 2, see especially FIG. 3 are beveled and both ends 26 of the bottom surface 27 see FIG. 4 of each opening 6 are beveled creating four mitre joints, see FIG. 2 at the four corners 28 of the panel 4.

In an alternative embodiment not shown in the drawings, the coupling arrangement comprises expandable glue or foam located within recesses on the inner surfaces of the openings and being expandable into correspondingly located recesses on the outer surfaces of the rails. Alternatively, the expandable glue or foam is located within recesses on the outer surfaces of the rails and being expandable into correspondingly located recesses on the inner surfaces of the openings.

Figure 2:
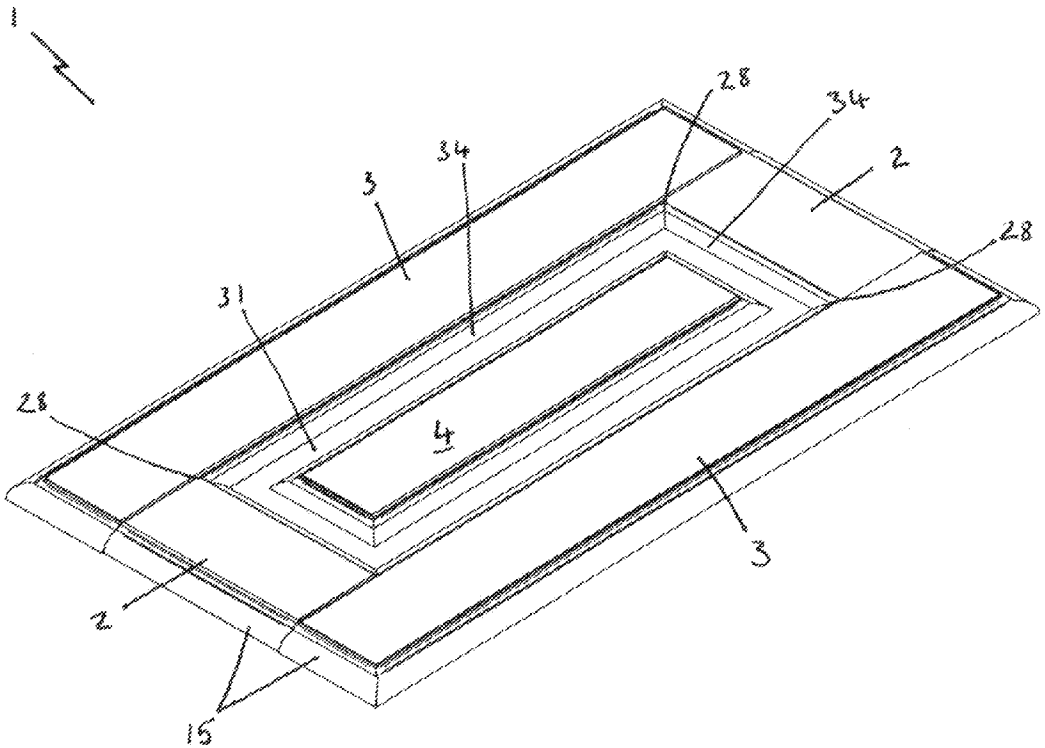
FIG. 2 is a perspective view of the three piece component in an in use position.
Figure 3:
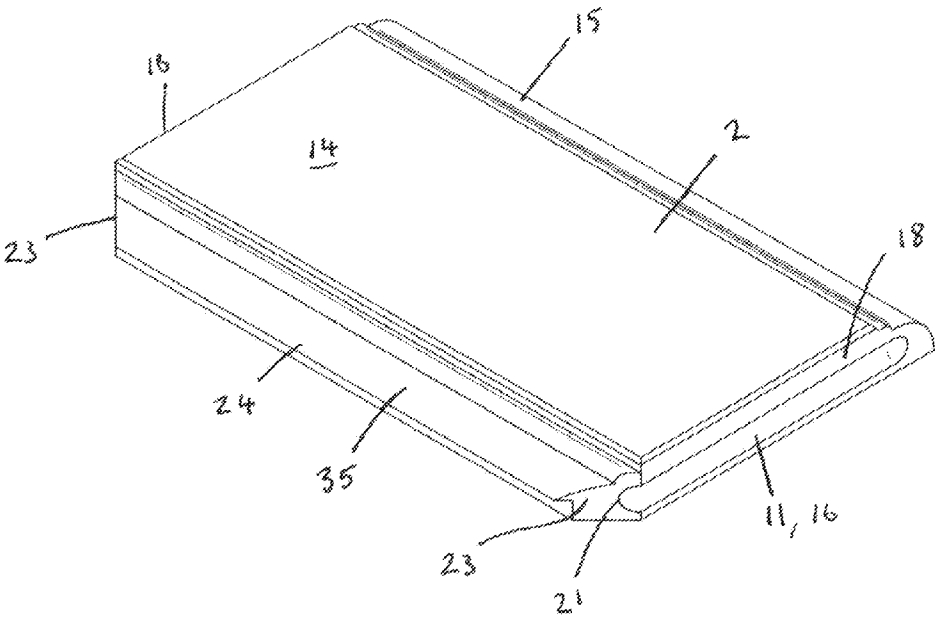
FIG. 3 is a perspective view of one of the separate rails.
Figure 4:
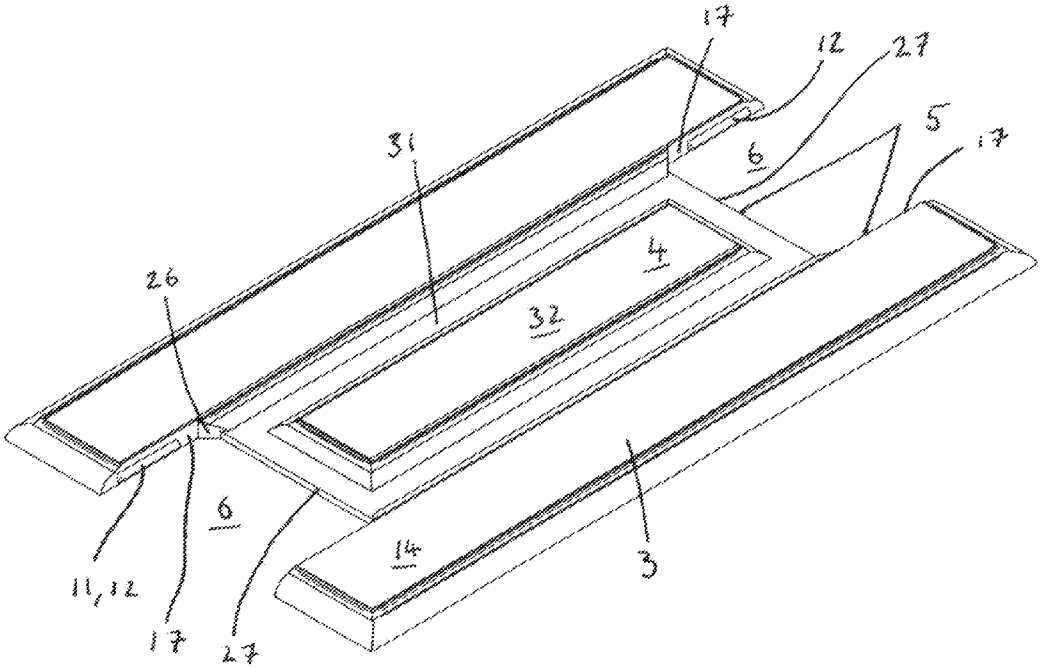
FIG. 4 is a perspective view of the H-shaped main body.

The panel 4 of the H-shaped main body 5 has an annular recessed portion 31 see FIG. 4 defining a central platform 32 and inclined surfaces 34 see FIG. 2 between the annular recessed portion 31 and the central platform 32 and stiles 3 and these inclined surfaces 34 are formed with an ornamental design 35. The leading edge 24 of each rail 2 has an inclined surface 35 with the same ornamental design formed thereon. When the rails 2 are located into the openings 6 the ornamental designs on the inclined surfaces 35 of the rails 2 align with the ornamental design on the inclined surfaces 34 of the main body 5 to form an aesthetic visual appearance for the central panel 4 of the door 1. The peripheral edge of the H-shaped main body 5 and the peripheral edge of each rail 2 is moulded providing a molded edge 15 around the perimeter of the door 1.

The H-shaped main body 5 is completely wrapped in a covering material/veneer 14 and the two separate rails 2 are completely wrapped in a covering material/veneer 14. The covering material/veneer 14 comprises a moisture resistant coating such as a sheet material capable of preventing the ingress of moisture into the base material of the H-shaped main body 5 and the separate rails 2. The covering material/veneer 14 is selected from a group consisting of PVC, vinyl, paint, melamine and a backing foil. In another embodiment, the covering layer is applied using a print transfer process. It will of course be appreciated that any means of applying a moisture resistant coating on to a support panel is encompassed within the scope of the invention.

Figure 10:
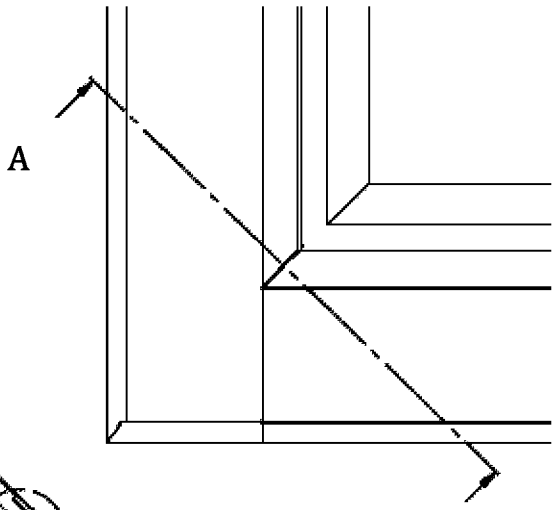
FIG. 10 is a partial elevational view of a corner of the second embodiment of three piece component.
Figure 11:
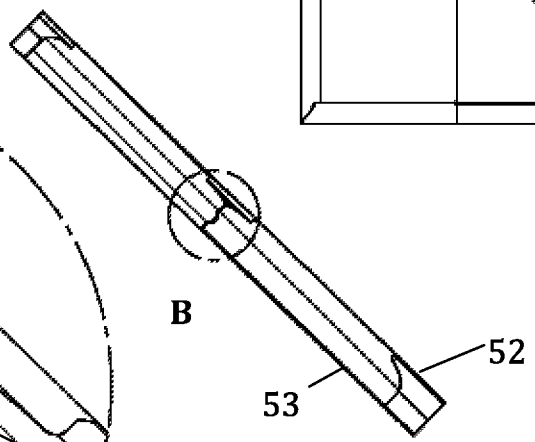
FIG. 11 is a section view from FIG. 10 taken along A-A.

With reference to the drawings shown in FIGS. 5 to 12, there is shown a second embodiment of three piece component indicated generally by reference numeral 51 which has a front visible surface 52 which is on display in normal use and a rear hidden surface 53 see FIG. 11 which is not visible unless the component is in an open position. Advantageously, this open position is only adopted for a minority of time compared to the normal closed position. The general three piece configuration of this second embodiment of three piece component 51 is practically identical to the general configuration of the first embodiment of three piece component 1. The main difference being that the second embodiment of three piece component 51 has a slightly different coupling arrangement 88, 89 described in greater detail below.

Figure 5:
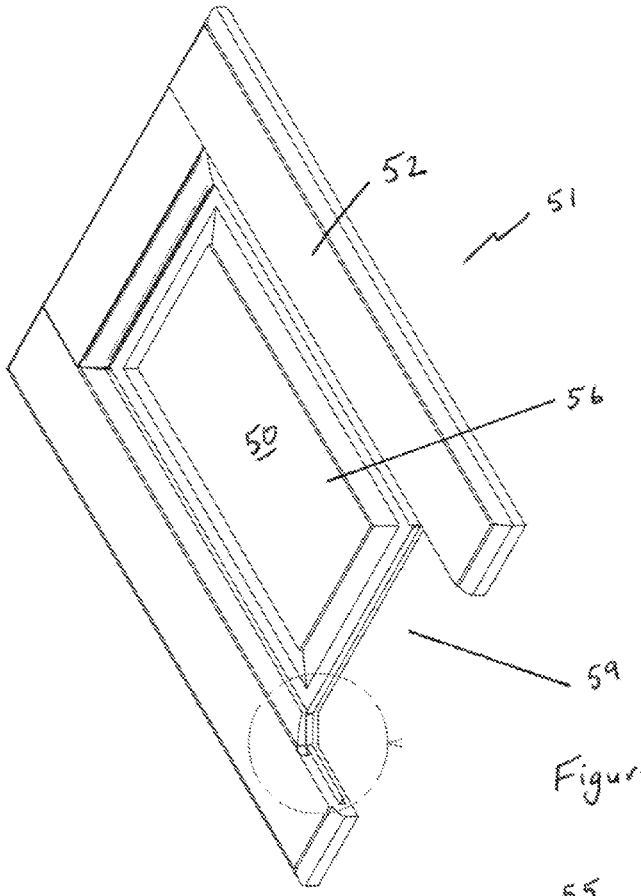
FIG. 5 is a perspective view of a second embodiment of three piece component.
Figure 6:
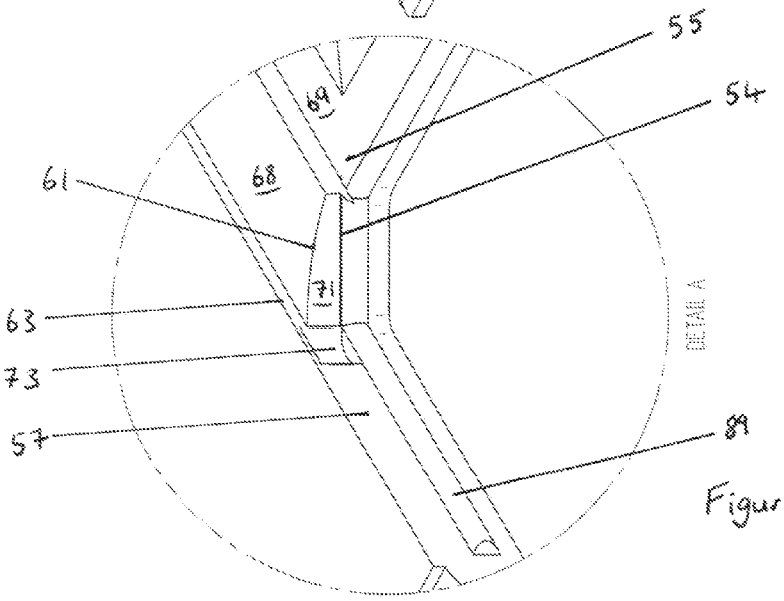
FIG. 6 is a detail view of the area marked A in FIG. 5.
Figure 7:
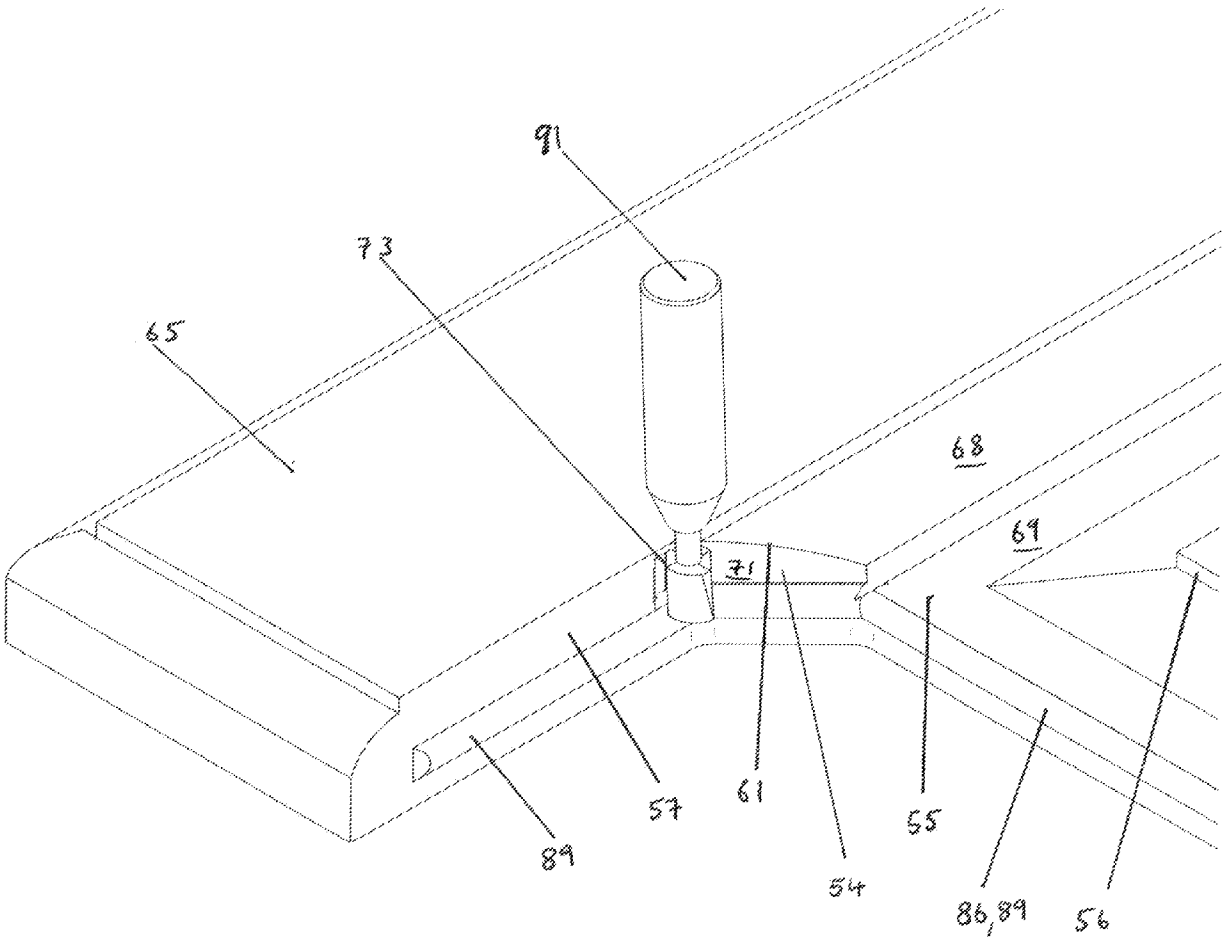
FIG. 7 is a detail view of an undercut being formed in a main body.

In the second embodiment of three piece component 51, a short beveled portion 54, see especially FIGS. 5-7 of the main body 50 extends between a location proximal to each corner 55 of a central panel 56 and a location along the internal surface 57 of the length of each of the protruding stile portions 65 defining the opening 59. Each short beveled portion 54 has an edge 61 proximal to the front visible surface 52 of the three piece component 51. The visible intersection between the edge 61 of each short beveled portion 54 with an edge 63 of the opening defining inner surface 57 of each stile 65 defines a sharp rectilinear intersection angle 66 see especially FIG. 10 with no visible internal radius. Advantageously, this sharply defined intersection angle 66 exactly imitates the visual appearance of the same part of a solid wood five piece door.

The edge 61 proximal to the front visible surface 52 of the three piece component 51 defines the boundary between the beveled inclined surfaces 68 extending between an annular recessed portion 69 and the stiles 65, see especially FIGS. 6 and 7, and the beveled surfaces 71 of the opening 59 which beveled surfaces 71 are substantially perpendicular to the main plane of the three piece component 51.

The sharp rectilinear intersection angle 66 with no visible internal radius is an angle in the range of 120° to 150°. This sharp rectilinear intersection angle 66 is achieved by the forming of an undercut 73 in the opening defining inner surface 57 of each stile 65 proximal to the intersection of the edge 61 of the short beveled portion 54 with the edge 63 of the opening defining inner surface 57 of each stile 65. The undercut 73 is formed a short distance below the main visible surface 52 of the stile 65. Advantageously, the integrity of the rectilinear edge 63 of the protruding portion of the stile 65 forming the opening 59 is unaffected by the undercut 73. The undercut 73 allows a specially designed cutting tool 81 see FIG. 7 to be buried into the body of the stile 65 so as to run out a true rectilinear edge 61 creating the sharp rectilinear intersection angle 66.

Figure 8:
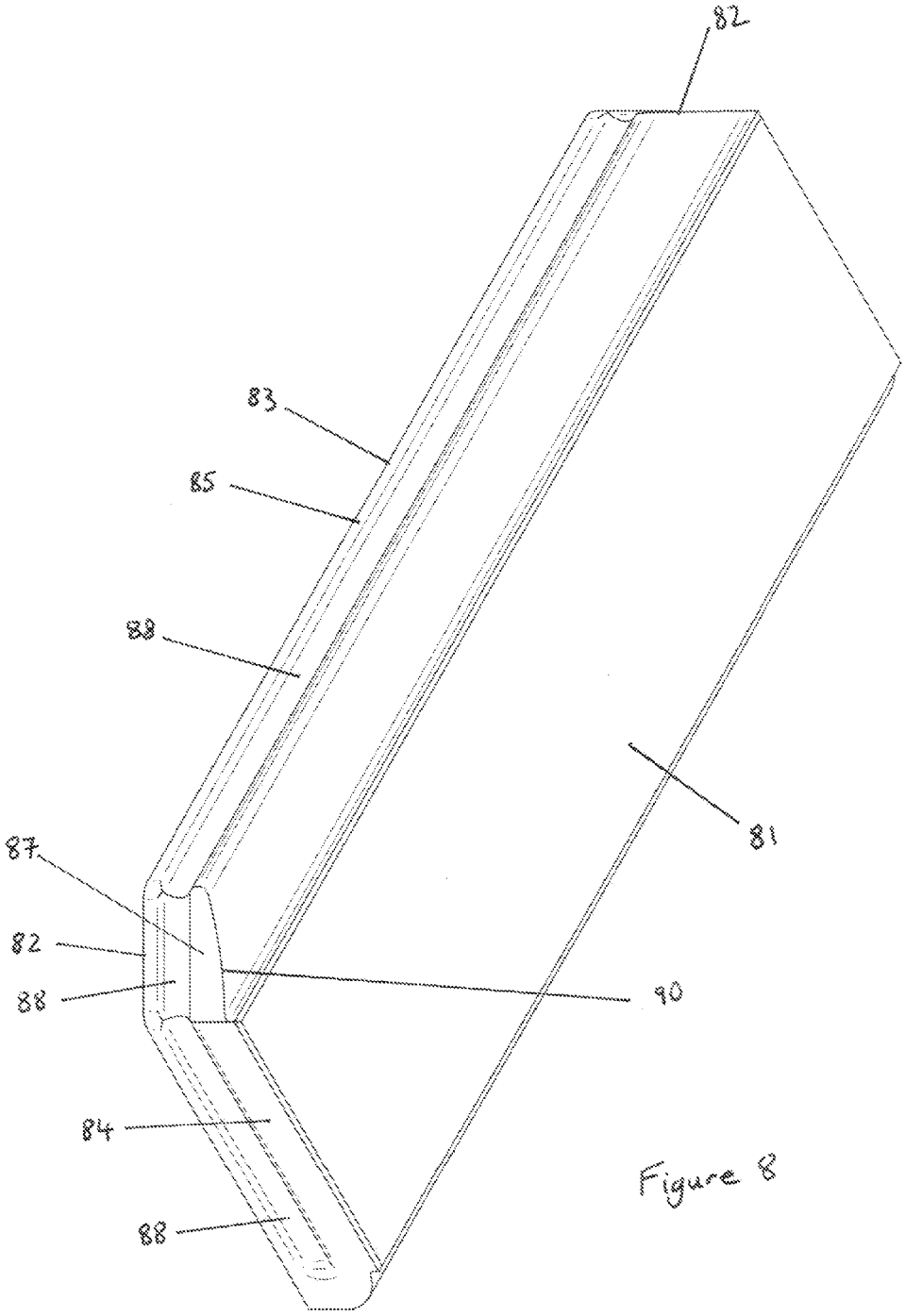
FIG. 8 is perspective view of a rail of the second embodiment of three piece component.
Figure 9:
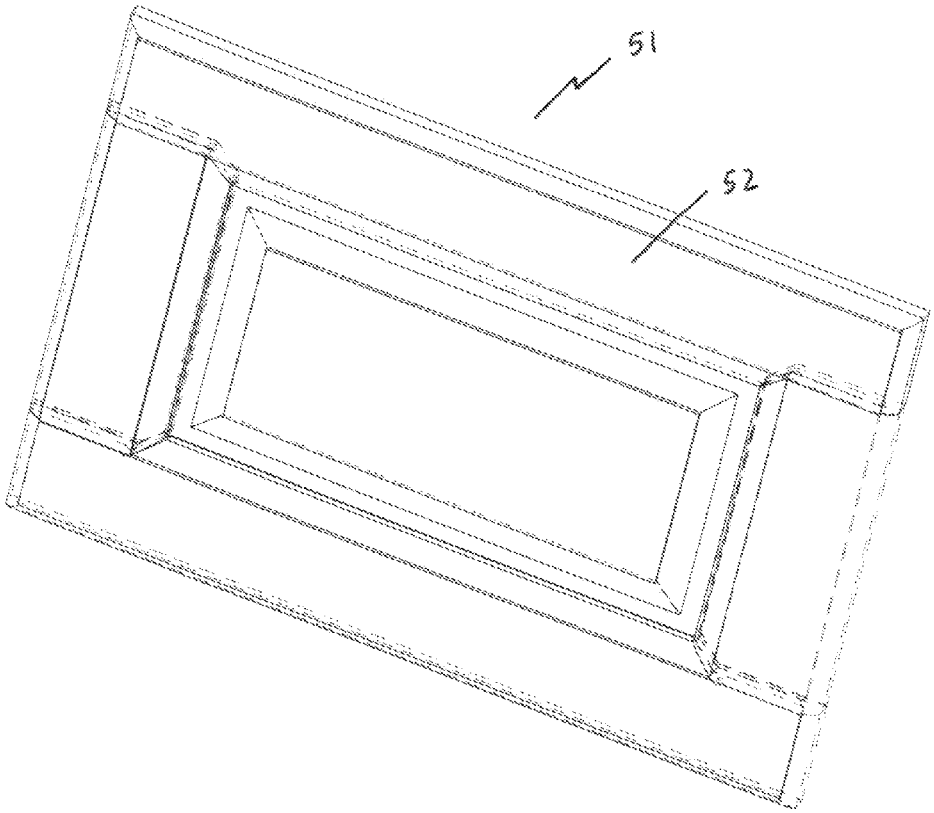
FIG. 9 is a hidden line perspective view of the second embodiment of three piece component.

In this particularly preferred embodiment, the separable rail 81 see FIG. 8 also has two short beveled portions 82 proximal to a leading edge 83 of the rail 81. The beveled portions 82 are formed between the outer lateral surfaces 84 formed for engagement with the opening defining surfaces 57 of the stiles 61 and a leading surface 85 of the rail 81 formed for engagement with an opening defining external surface 86 see FIG. 7 of the central panel 56. The beveled portions 82 of the rail 81 are formed for mating engagement with the beveled portions 54 of the opening 59 to create the beveled joints in the three piece door. Advantageously, these joints identically imitates the solid wood five piece door. The joints shown in the drawings are mitre joint.

The outer lateral surfaces 84, the beveled surfaces 87 of the beveled portions 82 and the leading surface 85 of the rail 81 have a coupling member 88 formed for operable engagement with a correspondingly located coupling member 89 see FIGS. 6 and 7 on the internal surfaces 57 of stiles 61, the beveled surfaces 71 of the beveled portion 54 and the external surface 86 of the central panel 56 forming the opening 59. The coupling members 88, 89 are provided by a rib 89 on the main body 50 and a groove 88 on the rail although it will of course be appreciated that any form of coupling arrangement as described above in relation to embodiment 1 can be used with the present invention.

Figure 12:
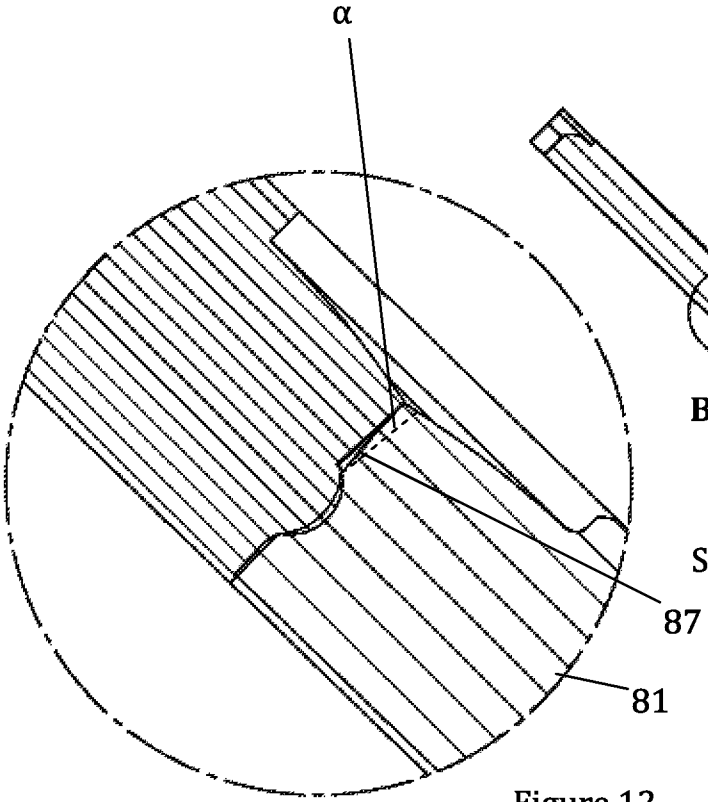
FIG. 12 is a detail view of detail B of the section view of FIG. 11.

Referring to the drawings and now particularly to FIGS. 10 to 12, the beveled surfaces 87 of the rail 81 are shown in section in FIG. 11 and in fine detail in FIG. 12. The beveled surfaces 87 taper at a slight angle $\alpha$ from the front visible surface 52 towards the rear hidden surface 53. The taper angle $\alpha$ is in the range of 1° to 5° with the actual angle being 3°. The two beveled surfaces 71 of the short beveled portions 54 of the main body 51 can also taper at a slight angle from the front visible surface 52 towards the rear hidden surface 53 although the surfaces 71 of the short beveled portions 54 shown in FIGS. 10 to 12 are substantially perpendicular to the main plane of the three piece component 51. Advantageously, the slight taper angle $\alpha$ of the beveled surfaces 87 means that the corresponding edges 90 see FIG. 8 of the beveled surfaces 87 of the rail 81 and the edges 61 of the beveled portions 54 of the main body 50 proximal to the front visible surface 52 of the three piece component 51 come into contact with each other before any other part of the beveled surfaces 87, 71 when the rails 81 are slid into position for forming the complete three piece component 51. This significantly mitigates against the risk of a visible gap between these corresponding edges 90, 61 thereby imitating the solid wood door as closely as possible.

Figure 14:
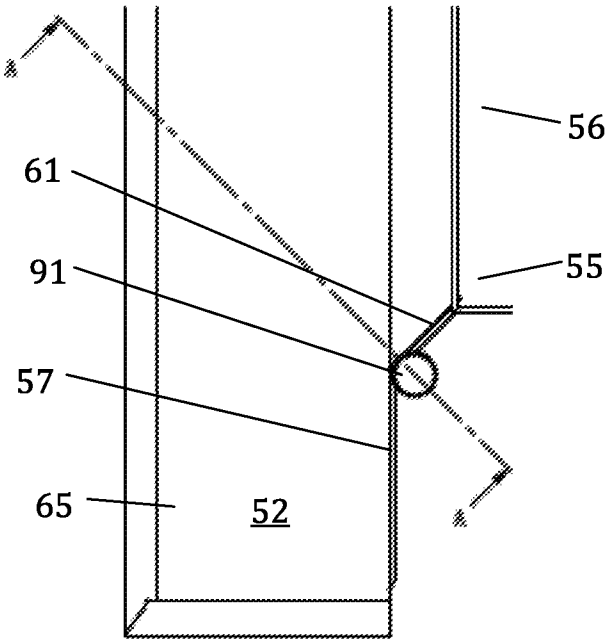
FIG. 14 is a partial elevational view of the visible surface of a corner of the main body of the three piece component.
Figure 15:
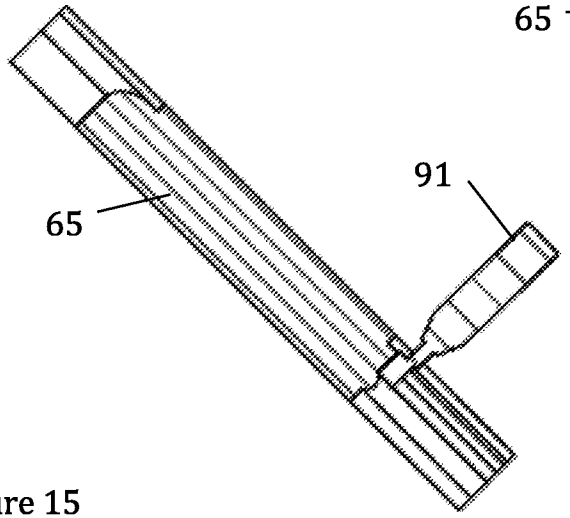
FIG. 15 is a section view taken along A-A of FIG. 14.

Referring to the drawings and in particular FIGS. 5 to 19, a method of forming a three piece component 51 is illustrated. The method has the steps of machining a quadrangular and most preferably rectangular blank of material to form a main body 50 having two stiles 65 and at least one panel member 54 intermediate and integrally formed with the two stiles 65. The blank is machined until opposing ends of the main body 50 have quadrangular and preferably substantially rectangular openings 59 in the main body 50 where the stiles 65 protrude beyond the main body 50. One preferred method of forming the blank into the main body 50 is using a cnc controlled router, not shown, having a specially designed cutting tool 91 mounted in the chuck of the router. The method further comprises machining two short beveled portions 54 see FIGS. 14 and 15 by running the cutting tool 91 between a location proximal to each corner 55 of the central panel 56 and a location along the internal surface 57 of the length of each of the protruding stile portions 65 defining the opening 59. The beveled portions 54 are machined so that each short beveled portion 54 has an edge 61 proximal to the front visible surface 52. The visible intersection between the edge 61 of each short beveled portion 54 with the edge 63 of the opening defining inner surface 57 of each stile 65 defines a sharp rectilinear intersection angle 66 see especially FIG. 10 with no visible internal radius. Advantageously, this sharply defined intersection angle 66 exactly imitates the visual appearance of the same part of a solid wood five piece door.

Figure 16:
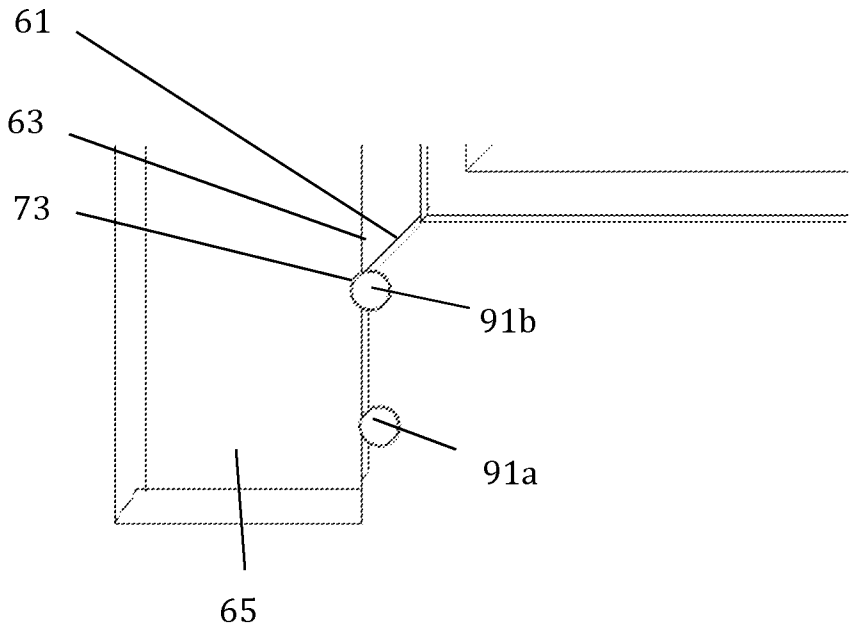
FIG. 16 is a partial elevational view of the visible surface of a corner of the main body of the three piece component and two positions of a machining tool.
Figure 17:
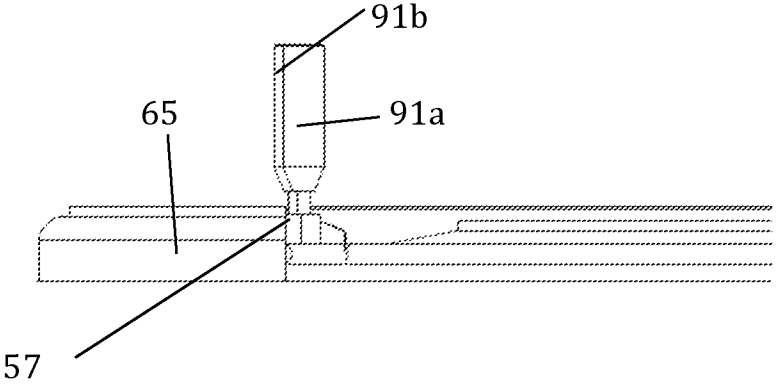
FIG. 17 is an end view of FIG. 16.
Figure 18:
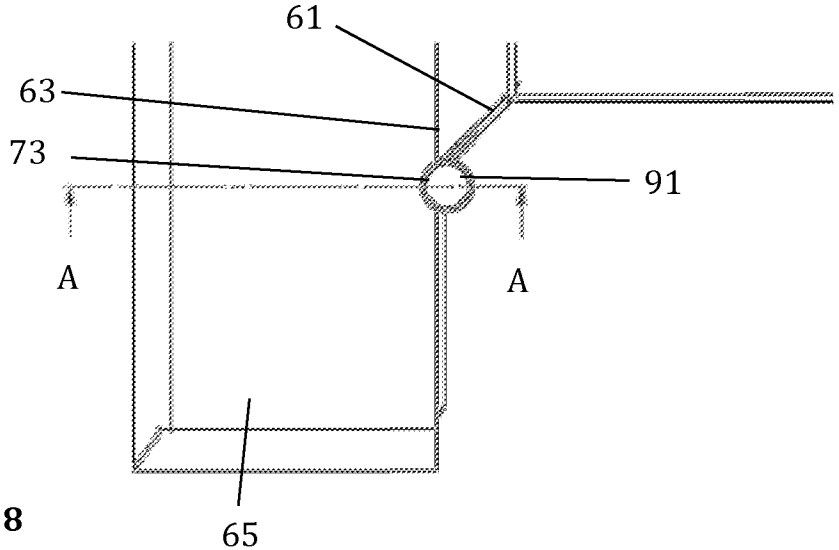
FIG. 18 is a partial elevational view of the visible surface of a corner of the main body of the three piece component and machining tool.
Figure 19:
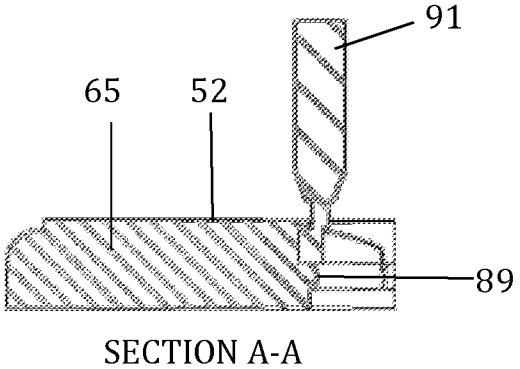
FIG. 19 is a section view taken along A-A of FIG. 18.

The method further comprises forming the sharp rectilinear intersection angle 66 with no internal radius at an angle in the range of 120° to 150° with the most preferred angle being 135° allowing a mitre joint between the beveled portions 82, 54 of the rails 81 and main body 50 respectively. The reason why the sharp rectilinear intersection angle 66 is achievable is because the method comprises the step of machining an undercut 73 see FIGS. 7 and 16 to 19 in the opening defining inner surface 57 of each stile 65 prior to or after machining the short beveled portions 54. Running the cutter head 97 of the cutting tool 91 into the body of the stile 65 in this way creates the straight edge 61 to intersect with the straight edge 63 of each protruding stile 65 so that no internal radius is visible at the intersection. The undercut 73 is machined a short distance below the main surface 52 of the stile 65 see FIGS. 6 and 19. Advantageously, the integrity of the rectilinear edge 63 of the protruding portion of the stile 65 forming the opening 59 is unaffected by the undercut 73. FIGS. 16 and 17 show the cutting tool 91 in two positions 91*a* and 91*b*. In 91*a* the cutting head 97 is shown at a position along the inner surface 57 of the stile 65 and in 91*b* the cnc program causes the cutter head 97 to move laterally into the body of the stile 65 thereby forming the undercut 73 as the cutter head 97 rotates into the body of the stile 65.

Figure 13:
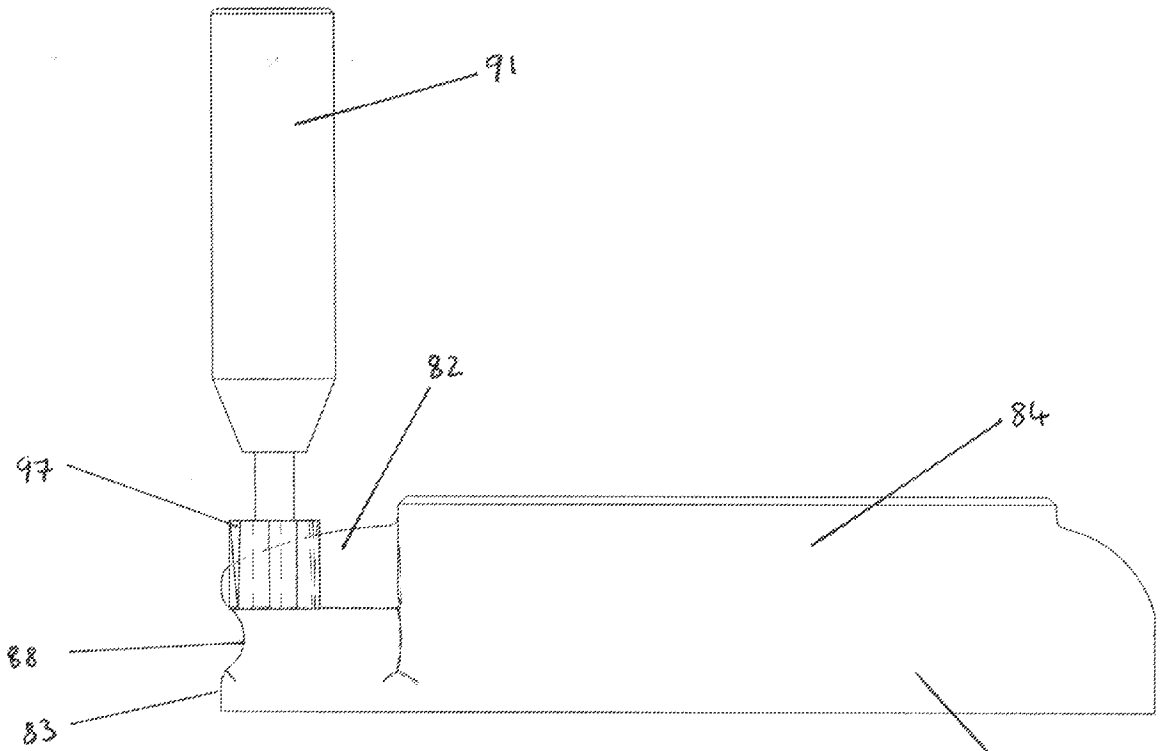
FIG. 13 is a end elevational view of a rail and machining tool.

The method also comprises machining the separable rail 81 see FIGS. 8 and 13 so as to have two short beveled portions 82 proximal to a leading edge 83 of the rail 81 between the outer lateral surfaces 84 formed for engagement with the opening defining surfaces 57 of the stiles 65 and a leading surface 85 of the rail 81 formed for engagement with an opening defining external surface 86 of the central panel 56, see FIG. 7. When forming the rails 81 and main body 50, the method comprises machining the beveled portions 82 of the rail 81 and the beveled portions 54 of the opening 59 to create a beveled joint, preferably a mitre joint. Advantageously, this joint identically imitates the solid wood five piece door.

When forming the rails 81, the method comprises machining the outer lateral surfaces 84, the beveled surfaces 87 and the leading surface 85 of the rail 81 so as to have a coupling member 88 formed for operable engagement with a correspondingly located coupling member 89 see FIGS. 6 and 7 machined on the internal surfaces 57 of the stiles 65, the beveled surfaces 71 of the beveled portions 54 and/or the external surface 86 of the central panel 56 forming the opening 59. As can be seen from FIGS. 7, 13 and 19, the depth of the cutter head 97 of the cutting tool 90 is less than the distance between the front visible surface 52 of the three piece component 51 and the coupling members 88 and 89. This feature allows the cutter head 97 to enter body of the stile 65 during the machining process to form the undercut 73 a slight distance below surface 52. The distance is within the range of 2-5 mm.

The machining method also comprises machining the beveled surfaces 71 of the short beveled portions 54 defining the opening 59 so as to taper at a slight angle from the front visible surface 52 towards the rear hidden surface 53, although this feature is not shown in the drawings. The taper angle $\alpha$ is formed on the cutter head 97 of the cutting tool 90. The method also comprises machining a taper angle in the range of 1° to 5°. The method also comprises machining the two short beveled surfaces 87 of the separable rails 81 so as to taper at a slight angle $\alpha$ from the front visible surface 52 towards the rear hidden surface 53, see FIG. 13 where the angle $\alpha$ is again in the range of 1° to 5°.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof as defined in the appended claims.

The invention claimed is:

1. A three piece component (1, 51) comprising:

a main body (5, 50) having two stiles (3, 65) and at least one central panel member (4, 56) intermediate to and integrally formed with the two stiles (3, 65), wherein each of the stiles comprises a protruding portion, wherein the central panel member comprises four corners, at least one end of the main body (5, 50) defining an opening (6, 59) in the main body (5, 50) where each of the stiles (3, 65) extend beyond the panel member (4, 56) forming the protruding portions and at least one rail (2, 81) being formed for insertion into the opening (6, 59) at the end of the main body (5, 50), wherein the main body further comprises a short beveled portion (54) extending between a location proximal to each of the corners of the central panel member (4, 56) and a location along internal surfaces (57) of each of the protruding portions defining the opening (6, 59), each said short beveled portion (54) having an edge (61) and each of said protruding portions having an edge (63) proximal to a front visible surface (52) of the three piece component, wherein a visible intersection between the edge (61) of each said short beveled portion (54) with the edge (63) of the opening defining said internal surfaces (57) of said stiles (65) defines a sharp rectilinear intersection angle (66) with no internal radius and wherein the opening comprises an undercut (73) formed in each of said stiles (65) proximal to the intersection of the edge (61) of the short beveled portion (54) with the edge (63) of the opening defining said internal surface (57) of each of said stiles (65), the undercut (73) allowing a specially designed cutting tool to be buried into each of said stiles (65) so as to form the edge of the short beveled portion as a true rectilinear edge (61) forming a sharp rectilinear intersection angle (66).

2. The three piece component (1, 51) as claimed in claim 1, wherein said rail (2, 81) is formed for insertion in said opening (6, 59) between the protruding portions of the stiles (3, 65).

3. The three piece component (1, 51) as claimed in claim 1, wherein the main body (5, 50) is substantially H-shaped.

4. The three piece component (1, 51) as claimed in claim 1, wherein the sharp rectilinear intersection angle (66) is an angle in the range of 120° to 150°.

5. The three piece component (1, 51) as claimed in claim 1, wherein the undercut (73) is formed a short distance below the front visible surface surface (52) of each of said stiles (65).

6. The three piece component (1, 51) as claimed in claim 1, wherein said rail comprises two rails, said rails (81) each having two short beveled portions (82) formed for mating engagement with the beveled portions (54) of the opening (59) to create beveled joints.

7. The three piece component (1, 51) as claimed in claim 6, wherein beveled surfaces (87) of the short beveled portions (82) of said rail (81) taper at a slight angle from the front visible surface (52) towards a rear hidden surface (53).

8. The three piece component (1, 51) as claimed in claim 7, wherein the taper comprises an angle in the range of 1° to 5°.

9. The three piece component (1, 51) as claimed in claim 1, wherein beveled surfaces (71) of the short beveled portions (54) defining the opening (59) in the main body (50) taper at a slight angle from the front visible surface (52) towards a rear hidden surface (53) of the three piece component.

10. The three piece component (1, 51) as claimed in claim 9, wherein the taper comprises an angle in the range of 1° to 5°.

* * * * *